United States Patent [19]

Ohlson, Jr.

[11] 4,400,142

[45] Aug. 23, 1983

[54] MOTOR-COMPRESSOR UNIT

[75] Inventor: Harry E. Ohlson, Jr., Syracuse, N.Y.

[73] Assignee: Carrier Corporation, Syracuse, N.Y.

[21] Appl. No.: 260,498

[22] Filed: May 4, 1981

[51] Int. Cl.[3] ..... F04B 39/02; F01M 1/02

[52] U.S. Cl. ..... 417/372; 184/6.18

[58] Field of Search ..... 417/372, 368, 902; 184/6.18, 6.28, 26; 415/90, 143

[56] References Cited

U.S. PATENT DOCUMENTS 3,584,980 12/1968 Cawley et al. ..... 417/372 X 3,926,281 12/1975 Hannibal ..... 184/6.16

4,131,396 12/1978 Privon et al. ..... 417/372

*Primary Examiner*—Richard E. Gluck

*Assistant Examiner*—Peter M. Cuomo

*Attorney, Agent, or Firm*—Donald F. Daley; David J. Zobkiw

[57] ABSTRACT

A motor-compressor unit comprising a compressor including a rotatable crankshaft, a motor, a shell enclosing the compressor and the motor, a supply of lubricant, and a lubrication system for circulating lubricant through the compressor. The lubrication system includes a first stage axial passage, a second stage axial passage extending upward from an upper portion of the first stage axial passage, a first stage radial passage extending outward from the first stage axial passage, and a second stage radial passage extending outward from the second stage axial passage. The lubrication system further comprises an interstage collection chamber for receiving lubricant directed through the first stage radial passage, and an interstage conduit for conducting lubricant from the interstage collection chamber into the second stage axial passage.

6 Claims, 2 Drawing Figures

MOTOR-COMPRESSOR UNIT

BACKGROUND OF THE INVENTION

Figure 1:
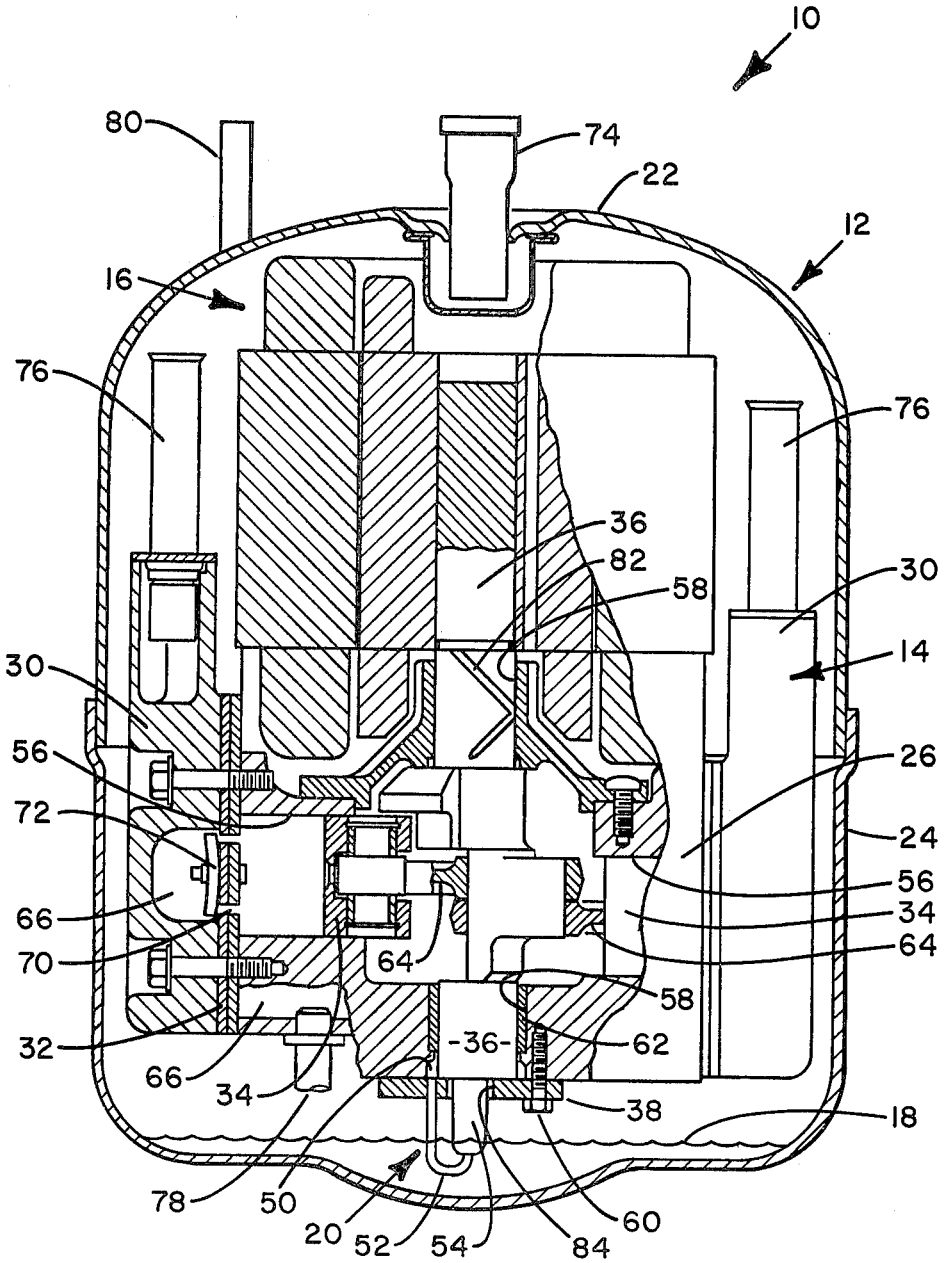

This invention generally relates to motor compressor units, and more particularly to lubrication systems therefor.

The utilization of hermetically and semi-hermetically sealed motor-compressor units has become increasingly prevalant in recent years, particularly in refrigeration applications where the motor-compressor unit is employed to compress refrigerant vapor. Conventionally, the motor-compressor unit includes a compressor, a motor such as an electric motor, and a shell enclosing both the compressor and the motor. The compressor defines one or more compression chambers, and a compression means, for example a reciprocating piston, is movably disposed within each compression chamber. The compressor also includes a rotatable crankshaft which is connected to both the motor and the compressor means; and the motor drives or rotates the compressor crankshaft, while rotation of the crankshaft moves the compression means within the compression chamber or chambers to compress vapor therewithin.

Often, the crankshafts of many motor-compressor units of the general type described above rotate at relatively high speeds, for example 3,500 rpm. As is obvious, at such high operating speeds, proper lubrication of the compressor elements such as the bearings or surfaces journaling the compressor crankshaft is very critical. Any lubrication problems, when operating at these high speeds, may result, for example, in bearing failure, eventually causing complete loss of the compressor. For this reason, the motor-compressor unit is usually provided with a supply of lubricant and a lubrication system to circulate the lubricant through the compressor.

Commonly, these lubrication systems includes a single stage lubricant pump. However, under many conditions it is preferred to provide a motor-compressor unit with a lubrication system having a two-stage lubricant pump. For example, if a compressor is designed to operate selectively at either half or full speed, a two-stage pump may be necessary to insure that the lubrication system provides adequate lubricant pressure at both of these speeds. In addition, a two-stage lubrication pump may be needed if the shell of the motor-compressor unit is filled with relatively hot, high pressure discharge vapors—as opposed to relatively cool, low pressure suction vapors, which is normally the case.

Specifically, as is known in the art, some vapors are naturally absorbed in the compressor lubricant and, as the lubricant is circulated through the compressor, the absorbed vapors tends to flash or boil out of the lubricant. The flashed vapors may collect within the passages of the compressor lubrication system, creating a pressure barrier to the flow of lubricant therethrough. Generally, the quantity of vapors which is absorbed in the lubricant and the associated pressure barrier to the flow of lubricant through the lubrication system tend to increase with the pressure and temperature of the vapors; and if the shell of the motor-compressor unit is filled with hot, high pressure discharge vapors, a single stage lubrication pump may not be sufficient to provide a proper flow of lubricant to the working parts of the compressor, necessitating a two-stage lubrication system. Moreover, even if a single stage lubricant pump provides adequate lubrication under the circumstances described above, a two-stage lubrication pump may be desirable to increase the flow of lubricant to the working elements of the compressor, thus increasing the cooling effect which the lubricant flow has on these working parts.

With conventional two-stage lubricant pumps, the compressor crankshaft extends downward into the lubricant supply and defines a multitude of radial and axial passages. As the crankshaft rotates, lubricant is drawn upward through a first stage, axially extending passage and then forced outward through a first radial passage, increasing the pressure of the lubricant. The lubricant is then conducted radially inward, through a passage defined by a thrust bearing located directly below the crankshaft, to a second stage, axially extending passage. Lubricant is conducted upward through the second axially extending passage and then again forced radially outward, further increasing the pressure of the lubricant. The lubricant is thence conducted via a plurality of grooves and bores defined by the crankshaft toward or to the various surfaces of the compressor requiring lubrication.

These prior art arrangements have a number of disadvantages or drawbacks. First, they require extending the compressor crankshaft into the lubricant. This, of course, increases the mass and cost of the crankshaft. Further, if the level of lubricant in the shell ever falls below the bottom of the crankshaft, the entire lubrication system is rendered ineffective. Second, with the prior art two-stage arrangements, the axially extending passage of one or the other or both of the two stages must be spaced from the rotational axis of the crankshaft, an arrangement which does not fully maximize the forces which the rotating shaft may apply to the lubricant. Third, the construction and design of the prior art systems have been somewhat complicated, often requiring, for example, the careful machining of one or more grooves or channels in the top surface of a thrust bearing which supports the compressor crankshaft.

A SUMMARY OF THE INVENTION

In view of the above, an object of this invention is to improve motor-compressor units, particularly lubrication systems therefor.

Another object of the present invention is to extend both a first stage and a second stage axial passage of a lubrication system for a motor-compressor unit through the rotational axis of the crankshaft of the motor-compressor unit.

Still another object of this invention is to employ a lubricant pick-up tube to conduct lubricant upward from a supply thereof to the first stage of a two stage lubrication system for a motor-compressor unit.

A further object of the present invention is to conduct lubricant from a first stage of a multi-stage lubrication system for a motor-compressor unit, axially past a thrust bearing located below the crankshaft of the motor-compressor unit, and thence to a second stage of the lubrication system.

These and other objectives are attained with a motor-compressor unit comprising a compressor including a rotatable crankshaft, a motor connected to the compressor crankshaft to rotate the crankshaft, a shell enclosing the compressor and the motor, a supply of lubricant located in the bottom of the shell, and a lubrication system for circulating lubricant through the compressor. The lubrication system includes first and second stage axial passages and first and second stage radial passages, all defined by the crankshaft.

The first stage axial passage extends upward from a bottom of the crankshaft, in communication with the lubricant supply, and surfaces of the crankshaft which define the first stage axial passage project around a first portion of the rotational axis of the crankshaft; and the second stage axial passage extends upward from an upper portion of the first stage axial passage, and surfaces of the crankshaft which define the second stage axial passage project around a second portion of the rotational axis of the crankshaft. The first stage radial passage extends radially outward from the first stage axial passage, and the second stage radial passage extends radially outward from the second stage axial passage. The lubrication system further comprises means defining an interstage collection chamber for receiving lubricant directed outward through the first stage radial passage; and an interstage conduit having a first end in communication with the interstage collection chamber, and extending downward therefrom and then upward through the first stage axial passage and into the second stage axial passage.

With this arrangement, rotation of the crankshaft draws lubricant from the lubricant supply, through the first stage axial passage, and into the first stage radial passage. The shaft forcibly directs the lubricant through the first stage radial passage to increase the pressure of the lubricant and to direct the lubricant through the interstage collection chamber, the interstage conduit, the second stage axial passage, and into the second stage radial passage. The shaft also forcibly directs the lubricant through the second stage radial passage, further increasing the pressure of the lubricant.

A BRIEF DESCRIPTION OF THE DRAWINGS

Figure 2:
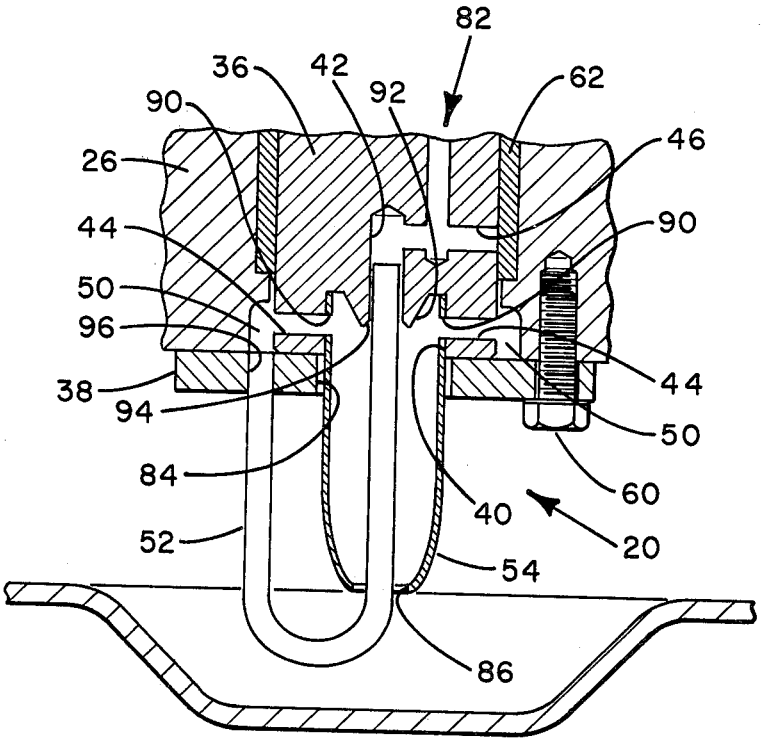

FIG. 1 is a longitudinal, sectional view of a motor-compressor unit incorporating teachings of the present invention; and FIG. 2 is an enlarged sectional view of a portion of the motor-compressor unit illustrated in FIG. 1, showing a more detailed view of the two stage lubrication pump of the motor-compressor unit.

A DETAILED DESCRIPTION OF THE PREFERRED EMBODIMENT

Referring to the drawings, there is disclosed motor-compressor unit 10 illustrating a preferred embodiment of the present invention. Generally, motor-compressor unit 10 includes shell 12, compressor 14, motor such as electric motor 16, lubricant supply 18, and lubrication system 20. More specifically, shell 12 includes top and bottom, horizontally split sections 22 and 24. Compressor 14 includes compressor block 26, cylinder heads 30, valve plates 32, pistons 34, crankshaft 36, and thrust bearing 38. Lubrication system 20 includes first and second stage axial passages 40 and 42 defined by lower portions of crankshaft 36, first and second stage radial passages 44 and 46 also defined by lower portions of the crankshaft, interstage lubricant collection chamber 50, and interstage conduit 52, and preferably the lubrication system further includes lubricant pick-up tube 54.

Particularly referring to FIG. 1, compressor block 26, as is conventional, defines cylinder chambers 56 and shaft opening 58. Pistons 34 are reciprocally disposed within cylinder chambers 56, and crankshaft 36 is rotatably supported within shaft opening 58, preferably via thrust bearing 38. In particular, thrust bearing 38 is conventionally secured, for example by bolts 60 (only one is shown in the drawings), to the bottom of compressor block 26; and the thrust bearing extends across shaft opening 58, below crankshaft 36, rotatably supporting the crankshaft. It should be pointed out that a thrust washer (not shown) may be located between opposed surfaces of crankshaft 36 and thrust bearing 38, and that the thrust bearing may be formed integrally with compressor block 26. Also, lower bushing 62 may be disposed between lower portions of crankshaft 36 and compressor block 26 to facilitate relative movement therebetween.

Pistons 34 are connected via connecting rod 64 to crankshaft 36, wherein rotation of the crankshaft causes the pistons to reciprocate within cylinder chambers 56 to compress vapor drawn thereinto. Valve plates 32 extend over cylinder chambers 56 and cylinder heads 30 extend over both the valve plates and compressor block 26. Cylinder heads 30 are conventionally secured to compressor block 26, securely holding valve plates 32 therebetween. Cylinder heads 30 and valve plates 32 define suction plenums (not shown); and the cylinder heads, the valve plate, and compressor block 26 cooperate to define discharge plenums 66. Valve plates 32 define inlet ports (not shown) and discharge ports 70 for conducting fluid from the suction plenums into cylinder chamber 56 and from the cylinder chambers into discharge plenums 66 respectively. Suction valves (not shown) and discharge valves 72 are connected to valve plates 32 to control vapor flow through the inlet and discharge ports respectively.

In assembly, motor 16 is connected to compressor 14, specifically crankshaft 36 thereof, to rotate the compressor crankshaft and, thus, drive the compressor, and preferably the motor is located above and supported by the compressor. Both compressor 14 and motor 16 are enclosed and supported within shell 12, which is formed by joining shell sections 22 and 24 together, for example by welding, along a horizontal seam. Lubricant supply 18 is disposed within the bottom or sump of shell 12 in communication with lubrication system 20.

In the preferred operation of motor-compressor unit 10, low pressure vapor enters shell 12 via inlet 74 and flows over motor 16, cooling the motor. The vapor then enters tubes 76, which are connected to the top portion of cylinder heads 30, and these tubes conduct the vapor into the suction plenums defined by the cylinder heads. As pistons 34 reciprocate within cylinder chambers 56, vapor is drawn from the suction plenums through valve plates 32 and into the cylinder chambers, compressed therewithin, and discharged from the cylinder chambers through discharge ports 70 of valve plates 32 and into discharge plenums 66. Therefrom, line 78 (only partially shown in FIG. 1) conducts the compressed vapor to outlet line 80, through which the compressed vapor is discharged from shell 12.

As is well understood in the art, it is essential that compressor 14 be properly lubricated during the above-described operation. In accordance with the present invention, motor-compressor unit 10 is provided with a very simple yet reliable and highly efficient two stage lubrication system 20 to insure adequate lubrication of compressor 14.

Discussing lubrication system 20 in greater detail, with particular reference to FIG. 2, first stage axial passage 40 extends upward from the bottom of crankshaft 36 and is in communication with lubricant supply 18, preferably via lubricant pick-up tube 54. Also, the surfaces of crankshaft 36 which define first stage axial passage 40 project around, preferably concentric with, a first portion of the rotational axis of the crankshaft. Second stage axial passage 42 extends upward from upper portions of first stage axial passage 40, and the surfaces of crankshaft 36 which define the second stage axial passage project around, preferably concentric with, a second portion of the rotational axis of the crankshaft. First stage radial passage 44 extends radially outward from first stage axial passage 40, preferably from two, opposite sides thereof, and second stage radial passage 46 extends radially outward from second stage axial passage 42. Interstage collection chamber 50 is located radially outside crankshaft 36 for receiving lubricant directed through first stage radial passage 44; and interstage conduit 52 has a first end in communication with the interstage collection chamber, extends downward therefrom, and then upward through first stage axial passage 40 and into second stage axial passage 42.

With the above-described arrangement, as compressor crankshaft 36 rotates, a low pressure region is developed at the lower end or inlet of first stage axial passage 40. As a result of this low pressure, lubricant is drawn, preferably via lubricant pick-up tube 54, from lubricant supply 18, into and through first stage axial passage 40, and into first stage radial passage 44. The surfaces of shaft 36 defining first stage radial opening 44 forcibly direct the lubricant radially outward therethrough, increasing the pressure of the lubricant. This lubricant is collected in interstage collection chamber 50 wherefrom the lubricant flows through interstage conduit 52, into and through second stage axial passage 42, and into second stage radial passage 46. The surfaces of shaft 36 defining second stage radial passage 46 forcibly direct the lubricant radially outward therethrough, further increasing the pressure of the lubricant. Conventional feed holes and grooves, generally referenced as 82, also defined by crankshaft 36 communicate with outer portions of second stage radial passage 46 to conduct lubricant therefrom toward or to the various bearings and other areas, such as lower bushing 62 and adjacent upper surfaces of compressor block 26 and crankshaft 36, of compressor 14 requiring lubrication.

Lubrication system 20 described above simultaneously achieves a number of desirable objectives. First, the rotational axis of crankshaft 36 extends through the axial passages 40 and 42 of both the first and second stages of lubrication system 20, allowing a very efficient use of forces developed by the shaft to increase the pressure of the lubricant. Second, lubrication system 20 effectively conducts lubricant between the stages thereof without requiring, for example, a cross-over channel in thrust bearing 38. Third, lubrication system may, and preferably does, employ lubricant pick up tube 54 to conduct lubricant upward from lubricant supply 18 to the first stage of the lubrication system, eliminating the need to extend crankshaft 36 into the lubricant supply.

Referring to lubricant pick-up tube 54 in greater detail, the pick-up tube has a first end located within first stage axial passage 40 and is connected to crankshaft 36 for rotation therewith, for example via a pressure fit between adjacent surfaces of the pick-up tube and the crankshaft. Pick-up tube 54, which generally is bullet shaped, extends downward from first stage axial passage 40, through a central opening 84 defined by thrust bearing 38, and into lubricant supply 18, with a second end of the pick-up tube defining tube inlet 86. It should be noted that, if lubricant pick-up tube 54 axially projects above first stage radial passage 44, the sides of the pick-up tube define openings 90 aligned with radial passage 44 to allow lubricant to flow from the interior of the pick-up tube into the first stage radial passage. Furthermore, with this preferred embodiment, interstage conduit 54 extends below pick-up tube 54, upward through tube inlet 86 and through the pick-up tube itself, and then into second stage axial passage 42.

Additionally, with the preferred embodiment of motor-compressor unit 10 illustrated in the drawings, crankshaft 36 defines a downwardly and inwardly inclined surface 92 generally facing first stage radial passage 44, and the crankshaft defines a beveled edge 94 surrounding a lower end of second stage axial passage 42. As will be understood, inclined surface 92 facilitates centrifuging lubricant radially outward through first stage radial passage 44, while beveled edge 94 assists inserting a second end of interstage conduit 52 into second stage axial passage 42.

Preferably, the second end of interstage conduit 52 is in a close fitting engagement with the surfaces of crankshaft 36 defining second stage axial passage 42, and the interstage conduit extends thereinto a major portion of the axial distance between the lower end or inlet of the second stage axial passage and the second stage radial passage 46. This close, relatively lengthy fit between the inside surfaces of crankshaft 36 defining axial passage 42 and the outside surfaces of the second end of interstage conduit 52 inhibits lubricant leakage from the second stage axial passage to first stage axial passage 40, effectively acting as a rotary seal therebetween. Moreover, preferably interstage collection chamber 50 is defined by compressor block 26, radially outside and adjacent to shaft 36, and the collection chamber annularly extends therearound. Also, it should be noted that preferably thrust bearing 38 projects below interstage collection chamber 50, the thrust bearing defines off-center opening 96 directly below a portion of the interstage collection chamber, and interstage conduit 52 axially extends through this off-center opening of the thrust bearing to conduit lubricant axially past the thrust bearing; and with this particular arrangement, the interstage conduit may be welded to the thrust bearing, securely holding the first end of the interstage conduit in place.

As may be understood from a review of the above remarks, lubrication system 20 is very simple and inexpensive, requiring relatively few parts and minimal time and skill to assemble and install, yet the lubrication system is highly efficient and reliable. Furthermore, the present invention is widely applicable, being easily employed with many types of motor-compressor units in addition to unit 10 specifically described above. For example, the present invention may be used with motor-compressor units having virtually any number of pistons, having either single speed or multi-speed motors, or having a shell filled with either low pressure suction vapor or high pressure discharge vapor.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A motor-compressor unit comprising:

a compressor including a rotatable crankshaft;

a motor connected to the compressor crankshaft to rotate the crankshaft;

a shell enclosing the compressor and the motor;

a supply of lubricant located in the bottom of the shell; and a lubrication system for circulating lubricant through the compressor and including a first stage axial passage defined by and coaxial with the crankshaft, extending upward from a bottom thereof, in communication with the lubricant supply, and wherein surfaces of the crankshaft which define the first stage axial passage project around a first portion of the rotational axis of the crankshaft, a second stage axial passage defined by and coaxial with the crankshaft, extending upward from an upper portion of the first stage axial passage, and wherein surfaces of the crankshaft which define the second stage axial passage project around a second portion of the rotational axis of the crankshaft, a first stage radial passage defined by the crankshaft and extending radially outward from the first stage axial passage, a second stage radial passage defined by the crankshaft and extending radially outward from the second stage axial opening, means defining an interstage collection chamber for receiving lubricant directed outward through the first stage radial passage, and an interstage conduit having a first end in communication with the interstage collection chamber, and extending downward therefrom and then upward through the first stage axial passage and into the second stage axial passage;

wherein rotation of the crankshaft draws lubricant from the lubricant supply, through the first stage axial passage, and into the first stage radial passage; forcibly directs the lubricant therethrough to increase the pressure of the lubricant and to direct the lubricant through the interstage collection chamber, the interstage conduit, the second stage axial passage, and into the second stage radial passage; and forcibly directs the lubricant therethrough to further increase the pressure of the lubricant.

2. The motor-compressor unit as defined by claim 1 further including a lubricant pick-up tube having a first end located within the first stage axial passage, connected to the crankshaft for rotation therewith, and axially extending downward from the first stage axial passage into the lubricant supply, and having a second end defining a tube inlet, and wherein the interstage conduit axially extends through the lubricant pick-up tube and the tube inlet.

3. The motor-compressor unit as defined by claim 2 wherein:

the lubricant pick-up tube projects above the first stage radial passage; and sides of the lubricant pick-up tube define an opening to allow lubricant to flow from the interior of the lubricant pick-up tube into the first stage radial passage.

4. The motor-compressor unit as defined by claim 1 or 2 wherein the crankshaft defines a downwardly and inwardly inclined surface generally facing the first stage radial passage to facilitate centrifuging lubricant therethrough.

5. The motor-compressor unit as defined by claim 4 wherein:

the crankshaft defines a beveled edge surrounding a lower end of the second stage axial passage to facilitate inserting the interstage conduit thereinto; and a second end of the interstage conduit is in a close fitting engagement with the surfaces of the crankshaft defining the second stage axial passage, and the interstage conduit extends thereinto a major portion of the axial distance between the lower end of the second stage axial passage and the second stage radial passage to inhibit lubricant leakage from the second stage axial passage to the first stage axial passage.

6. The motor-compressor unit as defined by claim 5 wherein:

the compressor further includes a compressor block;

the crankshaft is supported for rotation within the compressor block;

the interstage collection chamber is defined by the compressor block, radially outside and adjacent to the crankshaft; and the interstage collection chamber annularly extends around the crankshaft.

* * * * *